US007329977B2

(12) United States Patent
Van Gennip et al.

(10) Patent No.: US 7,329,977 B2
(45) Date of Patent: Feb. 12, 2008

(54) DISCHARGE LAMP WITH A REFLECTOR AND A BURNER

(75) Inventors: Nicasius Gerardus Van Gennip, Heeze (NL); Wilfried Emunds, Alsdorf (DE); Michael Haacke, Aachen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 523 days.

(21) Appl. No.: 10/504,663

(22) PCT Filed: Feb. 17, 2003

(86) PCT No.: PCT/IB03/00532

§ 371 (c)(1),
(2), (4) Date: Aug. 13, 2004

(87) PCT Pub. No.: WO03/071186

PCT Pub. Date: Aug. 28, 2003

(65) Prior Publication Data

US 2005/0146259 A1 Jul. 7, 2005

(30) Foreign Application Priority Data

Feb. 21, 2002 (DE) ..... 102 07 273

(51) Int. Cl.
*H01J 5/16* (2006.01)

(52) U.S. Cl. ..... 313/113; 348/786; 359/614

(58) Field of Classification Search ..... 313/113; 348/786; 359/614

See application file for complete search history.

(56) References Cited

U.S. PATENT DOCUMENTS 4,081,708 A * 3/1978 Notelteirs ..... 313/113
5,957,571 A * 9/1999 Koster et al. ..... 362/306
6,471,385 B1 * 10/2002 Emunds et al. ..... 362/519

FOREIGN PATENT DOCUMENTS

EP 1055873 A2 10/2000
JP 149646 5/2000

* cited by examiner

*Primary Examiner*—Joseph Williams
*Assistant Examiner*—Bumsuk Won

(57) ABSTRACT

The invention relates to a discharge lamp with a reflector (1) and a burner (2), wherein the reflector (1) comprises at least a reflective contour (3) and a hollow reflector neck (4), the burner (2) is arranged in centered manner in the reflector (1) and the reflector (1) and the lower part (2.1) of the burner (2) are connected firmly together by a mechanical fastening unit and, during assembly, the burner (2) may be guided through the reflector neck (4), starting with its upper part (2.2), and the mechanical fastening unit exhibits such play in the x, y and z directions that the burner (2) can be brought into a defined position relative to the reflector during assembly.

11 Claims, 4 Drawing Sheets

Figure 1:
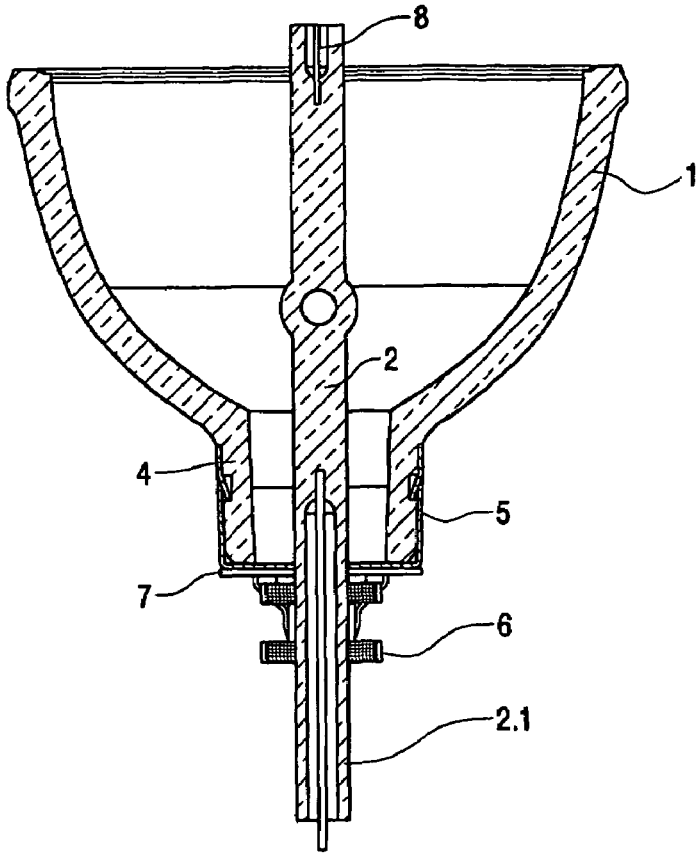

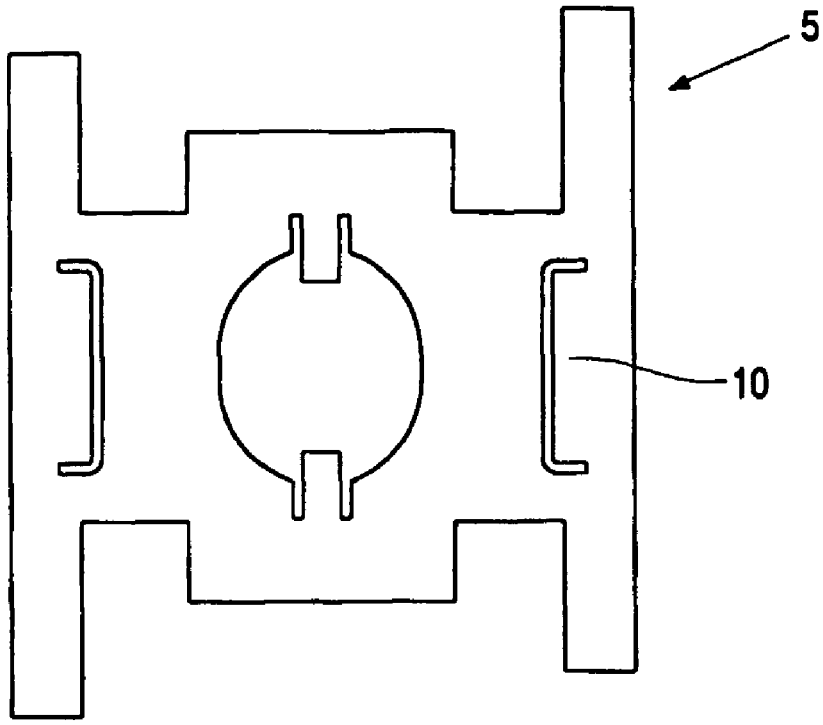
FIG. 5.1
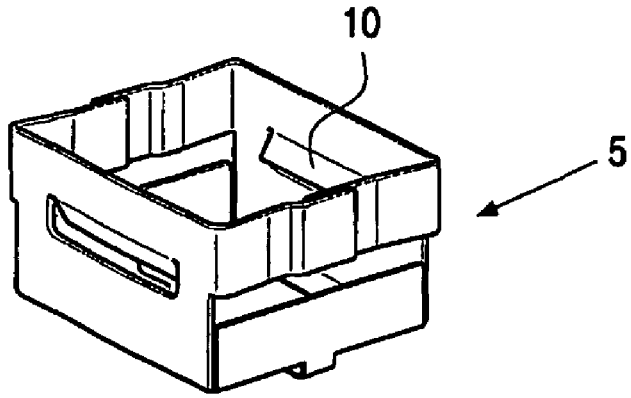
FIG. 5.2

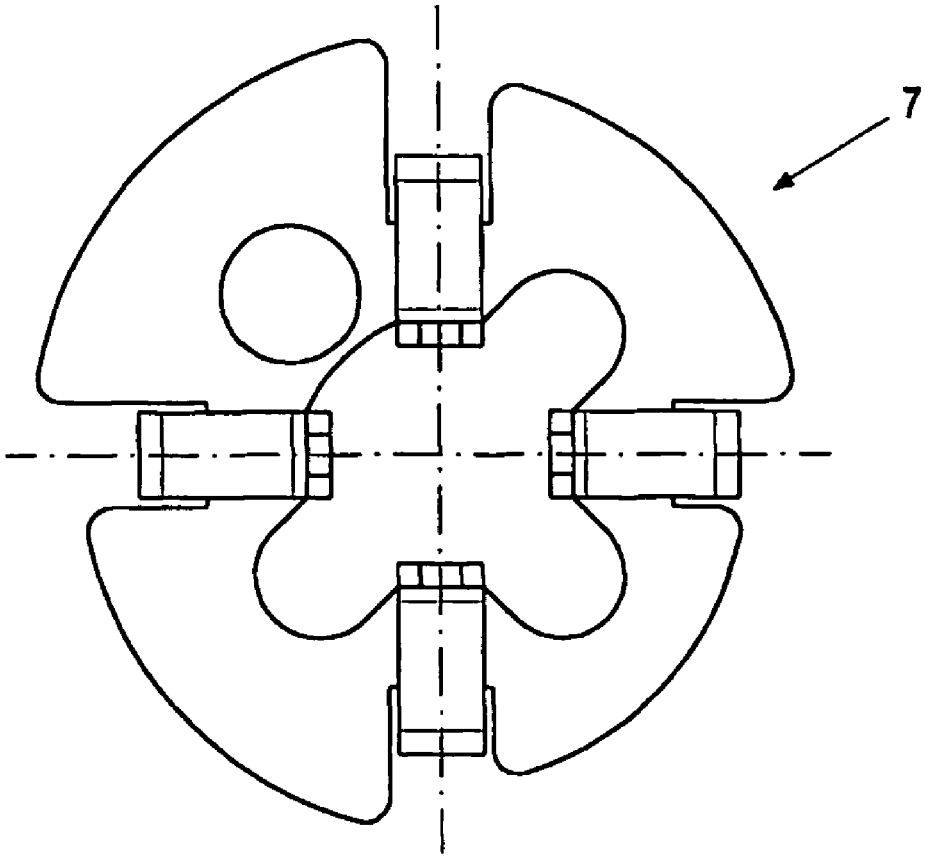
FIG. 6.1
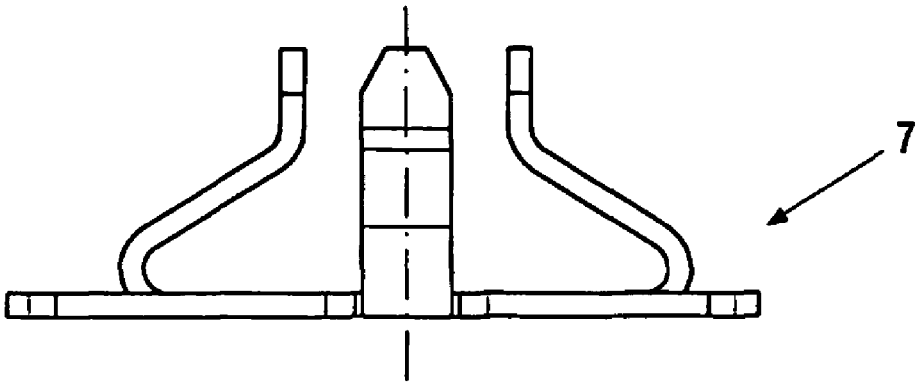
FIG. 6.2

DISCHARGE LAMP WITH A REFLECTOR AND A BURNER

The invention relates to a discharge lamp with a reflector and a burner, wherein the reflector comprises at least a reflective contour and a hollow reflector neck, the burner is arranged in centered manner in the reflector and the reflector and the lower part of the burner are connected firmly together by a mechanical fastening unit.

In the case of a discharge lamp which consists at least of a burner and a reflector, the light quality depends on various parameters, for example the efficiency of the reflector and in particular how the reflector and light source are adjusted one to the other. Defined positioning of the light source is of particular significance, in order to ensure the necessary focusing of the light on the focal point. When mass producing discharge lamps, the effort involved in defined positioning of the light source needs to be minimized.

A light source for the purposes of the invention may for example be a known burner of a discharge lamp with a return terminal. Such a burner, which may be used for example in headlights of automobiles, is asymmetric in form due to its construction. If such conventional discharge lamps are used, for example, in applications where light is emitted with the least possible loss and is focused on a point or a defined area, the efficiency of the reflector is dependent inter alia on the degree of focusing and hence in particular on the accuracy of the respective positioning. If the efficiency of the reflector is of particular significance, for example for applications where the light reflected by the reflector is coupled into a light guide, a significant impairment of light quality may be observed due to transmission losses which are routinely recorded in this case. When the light is coupled out of the light guide, losses again occur, such that the efficiency of the reflector in such a light guide system substantially co-determines the overall efficiency of the system. The achievable degree of focusing thus has a substantial effect on the overall efficiency of the system.

When such a light guide system is used as an automotive lighting system, in which standardized light quality values have routinely to be achieved, very precise and complex mutual adjustment of the optical system components is necessary. Where development is concerned, the emphasis is upon automotive light guide systems, which have at least one light source, at least comprising a discharge lamp with a reflector and a burner, which may also be asymmetric in form. These light guide systems include, inter alia, a system of light guide cables and optical elements, which in a known way effect and assist in coupling the light into and out of the light guide and providing the light for the desired application, for example, by means of automobile headlights.

JP 2000149646 describes positioning, determined with regard to a focal point, of a light source relative to a reflector and the fixing thereof. The reflector has a reflective contour and a hollow reflector neck. In the hollow reflector neck there is attached a hollow cylindrical sleeve in such a manner that the one end terminates at the reflective contour and the other, tapering end projects from the reflector neck. The light source, which has a cylindrical lower end, is guided outwards with its lower end through the cylindrical sleeve. At the knife-shaped end of the sleeve, the light source is held thereby only at that point wherein the light source is regularly tilted away from the lamp axis in the x and y directions.

Insertion from outside through the cylindrical sleeve is impossible, due to the geometric proportions of the light source. The lower end of the light source is subsequently received and held by a positioning aid. The positioning aid, which is movable in the x, y and z directions, effects the desired positioning of the light source in the reflector on the lamp axis. In this position, welding of the sleeve to the lower part of the light source is effected using laser beams. As a result of the above geometric proportions, tilting of the light source, i.e. deviation from the lamp axis, cannot be ruled out in the case of conventional manufacturing and handling tolerances, such that, where requirements with regard to coupling-in precision are very high, greater efforts with regard to quality control and/or associated separation out of unusable products will be necessary. The above procedure requires considerable expenditure when applied to the mass production usual for such products.

It is an object of the invention to provide a discharge lamp which may be produced technologically simply and cost-effectively and wherein the necessary luminous quality is ensured by a high reflector efficiency.

The object is achieved in that, during assembly, the burner may be guided through the reflector neck, starting with its upper part, and the mechanical fastening unit exhibits such play in the x, y and z directions that the burner may be brought into a defined position relative to the reflector during assembly.

The invention especially allows handling to be performed effectively during production of the discharge lamp in that, during assembly, the burner is introduced into the reflector through the reflector neck, starting with its upper part. Thus, a complex transfer of the burner from one positioning aid to another, as is absolutely essential when the burner is introduced starting with its lower part, is not necessary. A further aspect of the invention relates to the circumstance that the play present in the mechanical fastening unit is proportioned so that the burner may be brought into the desired position relative to the reflector during assembly by adjustment such that optimum focusing is ensured.

Discharge lamps for the purposes of the invention are all known lamp types with a burner and a reflector. Asymmetric burners are in particular burners which are known per se and are asymmetric in the x and y directions, for example burners of discharge lamps with return terminals.

The reflector according to the invention consists of conventional materials, such as glass, ceramics, metal and/or plastics.

Play for the purposes of the invention is the tolerance zone which exists between an aperture and a body introduced into this aperture, such that the body may move or be displaced in the aperture.

In a preferred construction of the arrangement according to the invention, the mechanical fastening unit comprises at least the following parts:

- a cap, which has a bearing surface in the x and y directions, which is arranged virtually perpendicularly to the lamp axis and is connected to the reflector,
- a collar, which may be moved during assembly virtually parallel to the lamp axis and is firmly connected to the lower part of the burner, and
- a sliding disk, which allows virtually parallel movement of the collar in the z direction during assembly and may be displaced in the x and y directions on the bearing surface of the cap.

This construction of the mechanical fastening unit allows positioning and adjustment to be performed in the simplest possible way. Centering or precentering relative to the lamp axis may be achieved by adjusting movements in the x and/or y directions of the sliding disk resting on the bearing surface of the cap. By simultaneous or subsequent movement of the collar in the sliding disk, which is allowed by the selected play, adjustment is ensured in the z direction, i.e. preferably along the lamp axis. The above movements in the x, y and z directions are routinely performed by conventional positioning aids, for example industrial robots, wherein positioning of the burners in the x, y and z directions is achieved in the conventional manner by means of predetermined reference points.

Parts of the fastening unit according to the invention may alternatively also be integral components of the reflector and/or the burner.

In a further preferred development of the invention, positioning of the burner at least in the z direction is performed when the discharge lamp is in the operating state. In this case, the illuminance is measured at a defined position, in particular where the highest degree of focusing is desired. The measured illuminance value is compared with a predetermined reference value or the position is determined at which the greatest illuminance could be detected. In this position, the parts of the mechanical fastening unit are fixed, preferably by using laser beams. This manner of determining the optimum position of the burner in the z direction allows further efficiency improvements to be made in the production of the discharge lamp according to the invention, since extensive tests have shown that deviations from the optimum position in the z direction, in contrast to deviations in the x and/or y directions, have a significant effect on the efficiency of the reflector.

It is moreover preferred for the lower part of the burner to project at least partially out of the hollow reflector neck. This arrangement in particular allows simple handling using the positioning aid.

After positioning in the above manner, fixing of this position is performed by bonding the parts of the mechanical fastening unit preferably by the use, known per se, of laser beams. The lasers, in particular commercially available industrial lasers, are selected and used inter alia as a function of the materials to be bonded.

The object of the invention is additionally achieved in that a discharge lamp as claimed in the claims 1 to 6 is used as light source in a light guide system which serves as an automotive lighting system and has at least one light source which comprises a discharge lamp with a reflector and a burner.

In addition to a light source, light guide systems include, for the purposes of the invention, a system of light guide cables and optical elements, which in a known way effect and assist in coupling the light into and out of the light guide and providing the light for the desired application, for example, for the purpose of illumination.

Figure 2:
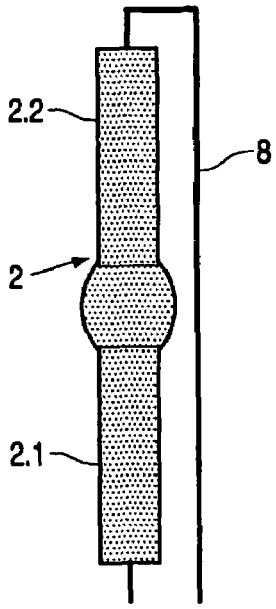
Figure 3:
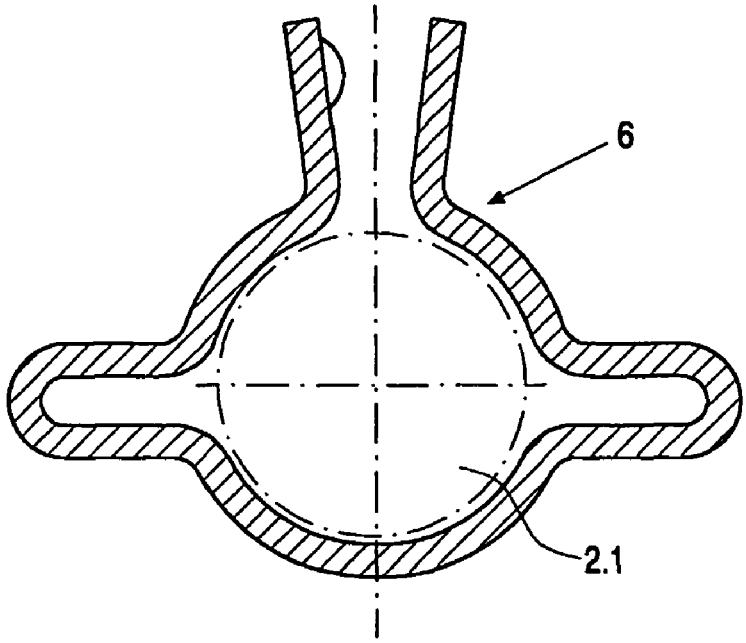
Figure 4:
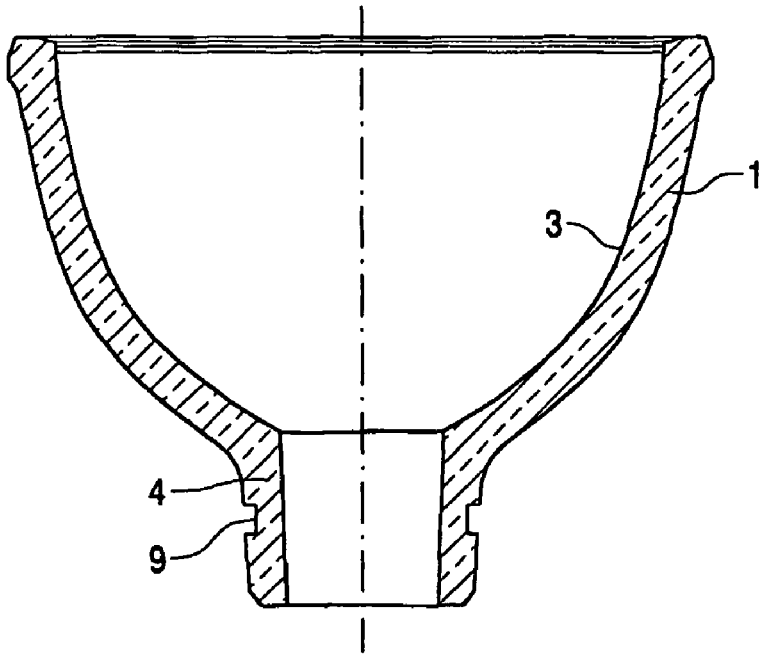

The invention will be further described with reference to an embodiment shown in the drawings to which, however, the invention is not restricted. In the Figures:

FIG. 1 is a sectional side view of the discharge lamp,

FIG. 2 is a schematic representation of the burner of a discharge lamp with a return terminal, FIG. 3 is a plan view of a collar as part of a mechanical fastening unit, FIG. 4 is a sectional side view of the reflector of a discharge lamp, FIG. 5 shows a plan view (FIG. 5.1) and a side view (FIG. 5.2) of a cap as part of a mechanical fastening unit, FIG. 6 shows a plan view (FIG. 6.1) and a side view (FIG. 6.2) of a sliding disk as part of a mechanical fastening unit.

FIG. 1 is a sectional side view of the discharge lamp according to the invention, wherein a burner 2 with a return terminal 8 is arranged in centered manner in a reflector 1. A box-shaped cap 5 is attached to the hollow reflector neck 4 and to the sliding disk 7. The sliding disk 7 is connected to the collar 6 which is arranged at the lower part 2.1 of the burner 2. The fastening unit, which ensures defined positioning of the burner 2 in the reflector 1, consists of the cap 5, the collar 6 and the sliding disk 7.

FIG. 2 is a schematic representation of the burner 2 with the return terminal 8 of a discharge lamp, wherein the burner 2 is connected in a known way and in electrically conductive manner to the return terminal 8. The burner 2 has a lower part 2.1' which is cylindrical in form, and an upper part 2.2, wherefrom the return terminal 8 projects.

FIG. 3 is a plan view of a collar 6 as part of a mechanical fastening unit prior to assembly thereof. In the installed position, the collar surrounds at least an area of the lower part 2.1 of the burner 2 and is connected thereto in a non-interlocking and/or interlocking manner, such that no relative movement is possible between these two parts.

FIG. 4 is a side view of the reflector of a discharge lamp with a return terminal (e.g. a Xenon lamp) for a light guide system for automotive front lighting. The reflector 1 here consists of borosilicate glass and has a reflective contour 3 and a hollow reflector neck 4. The lamp axis extends in the z direction of a three-dimensional system of coordinates. Formed in the outside of the reflector neck 4 are recesses 9 in which the resilient catch lugs 10 on the cap 5 firmly engage.

Altogether, the mechanical fastening unit fixes the burner 2 in a defined position, which ensures optimum luminosity and focusing of the reflected light on the focal point located outside the reflector 1. At this focal point, the reflected light is coupled in the usual way into a light guide cable known per se, for example, a glass fiber cable.

A metallic stamped and bent cap part, constituting part of a mechanical fastening unit, is shown in plan view prior to bending (FIG. 5.1) and in side view (FIG. 5.2). The cap 5 is a metallic stamped and bent part and, after bending, is substantially conformed in shape to that of the reflector neck 4 to be enclosed. It has a bearing surface or at least a plurality of bearing points which are arranged at a level in a plane in the x and the y direction. In this plane there is located an aperture through which the burner 2 and the collar, then arranged on the lower part 2.1, may be guided with play in the installation position. In the installation position, the cap 5 is arranged with its bearing surface virtually perpendicular to the lamp axis and is connected to the reflector neck 4 by the catch lugs 10 engaging in the recesses 9.

FIG. 6 shows a plan view (FIG. 6.1) and a side view (FIG. 6.2) of a sliding disk as part of a mechanical fastening unit. The metallic sliding disk 7 comprises a flat plate with two apertures, which plate in the installation position is arranged in the x and y directions and rests on the cap 5. The one aperture, which is conformed in shape to the shape of the collar 6, allows passage with play of the collar 6 arranged on the lower part 2.1. In the event of this passage or in the event of movement of the burner in the z direction, in particular during adjustment, the collar is guided with play by the guide aids. The four guide aids are connected firmly to the plate and are arranged in mutually opposing pairs. The other aperture serves for the passage of the return terminal and is dimensioned accordingly.

Industrial assembly of the reflector lamp according to the invention proceeds conventionally in the following stages. The collar is fixed in a predetermined area of the lower part of the burner and the sliding disk is pushed onto the collar. The cap is attached to the reflector neck, for example by catch engagement. With the assistance of a positioning aid, the burner is introduced into the hollow reflector neck through the one aperture in the cap, starting with the upper part of the burner. Subsequently, adjustment or precise positioning of the burner relative to the reflector is performed. Fixing, for example by laser beams, is then performed, while maintaining the desired position.

The invention claimed is:

1. A light guide system for use in an automotive lighting system, the light guide system at least comprising a light source, further comprising a discharge lamp having a reflector and a burner, the reflector at least comprising a reflective contour and a hollow reflector neck, the burner being arranged in centered manner in the reflector and the reflector and a lower part of the burner being connected firmly together by a mechanical fastening unit for fixing the burner into a defined position relative to the reflector to ensure optimum luminosity by exhibiting play in a direction coincident with the average light emission from the lamp and in a plane orthogonal to said coincident direction wherein the mechanical fastening unit comprises at least:

a cap, attached to the hollow reflector neck to enclose a portion of the hollow reflector neck, the cap being substantially conformed to the shape of the hollow reflector neck, the cap having a bearing surface which is arranged substantially perpendicular to a longitudinal axis of the lamp, a collar, rigidly connected to the lower part of the burner, and a sliding disk, resting on said bearing surface of said cap, the sliding disk being comprised of a flat plate including a first aperture and a second aperture and four guide aids rigidly connected to the flat plate arranged in mutually opposing pairs, the first aperture conformed to the shape of the collar for allowing passage with play of the collar arranged on the lower part of the burner, the second aperture being conformed to the shape of the return terminal for allowing passage of the return terminal, the sliding disk being displaceable in the x and y directions on the bearing surface of the cap for fixing the burner into said defined position relative to the reflector to ensure optimum luminosity.

2. A light guide system as claimed in claim 1, wherein the burner is an asymmetric burner with a return terminal.

3. A discharge lamp as claimed in claim 1, wherein said defined position of the burner in the x, y and z directions relative to the reflector to ensure optimum luminosity is achieved by means of predetermined reference points.

4. A discharge lamp as claimed in claim 1, wherein the positioning of the burner at least in the z direction is performed when the discharge lamp is in the operating state.

5. A discharge lamp as claimed in claim 1, wherein the lower part of the burner projects at least partially from the hollow reflector neck.

6. A discharge lamp as claimed in claim 1, wherein said fixing the burner into said defined position relative to the reflector to ensure optimum luminosity is performed via laser beams.

7. A discharge lamp having a reflector and a burner, the reflector at least comprising a reflective contour and a hollow reflector neck, the burner being arranged in centered manner in the reflector and the reflector and a lower part of the burner being connected firmly together by a mechanical fastening unit for fixing the burner into a defined position relative to the reflector to ensure optimum luminosity by exhibiting play in a direction coincident with the average light emission from the lamp and in a plane orthogonal to said coincident direction, wherein the mechanical fastening unit comprises at least:

a cap, attached to the hollow reflector neck to enclose a portion of the hollow reflector neck, the cap being substantially conformed to the shape of the hollow reflector neck, the cap having a bearing surface which is arranged substantially perpendicular to a longitudinal axis of the lamp, a collar, rigidly connected to the lower part of the burner, and a sliding disk, resting on said bearing surface of said cap, the sliding disk being comprised of a flat plate including a first aperture and a second aperture and four guide aids rigidly connected to the flat plate arranged in mutually opposing pairs, the first aperture conformed to the shape of the collar for allowing passage with play of the collar arranged on the lower part of the burner, the second aperture being conformed to the shape of the return terminal for allowing passage of the return terminal, the sliding disk being displaceable in the x and y directions on the bearing surface of the cap for fixing the burner into said defined position relative to the reflector to ensure optimum luminosity.

8. A discharge lamp as claimed in claim 7, wherein said defined position of the burner in the x, y and z directions relative to the reflector to ensure optimum luminosity is achieved by means of predetermined reference points.

9. A discharge lamp as claimed in claim 7, wherein the positioning of the burner at least in the z direction is performed when the discharge lamp is in the operating state.

10. A discharge lamp as claimed in claim 7, wherein the lower part of the burner projects at least partially from the hollow reflector neck.

11. A discharge lamp as claimed in claim 7, wherein said fixing the burner into said defined position relative to the reflector to ensure optimum luminosity is performed via laser beams.

* * * * *